US005841057A

United States Patent [19]

Birk

[11] Patent Number: 5,841,057

[45] Date of Patent: Nov. 24, 1998

[54] METHOD AND APPARATUS FOR LIQUID INJECTION TO REDUCE GUN BARREL EROSION

[75] Inventor: Aviezer Birk, Aberdeen, Md.

[73] Assignee: The United States of America as represented by the Secretary of the Navy, Washington, D.C.

[21] Appl. No.: 954,887

[22] Filed: Oct. 9, 1997

[51] Int. Cl.[6] ..... B64D 1/04

[52] U.S. Cl. ..... 89/1.25

[58] Field of Search ..... 89/1.25; 184/55.1

[56] References Cited

U.S. PATENT DOCUMENTS

| | | | |
|---|---|---|---|
| 797,237 | 8/1905 | Smith | 89/1.25 |
| 1,073,298 | 9/1913 | Smith | 89/1.25 |
| 1,350,645 | 8/1920 | Eickhoff | 89/1.25 |
| 1,423,757 | 7/1922 | Dawson et al. | 89/1.25 |
| 4,203,364 | 5/1980 | Dobbs | 102/38 |
| 4,858,534 | 8/1989 | Wallace | 89/1.25 |
| 5,034,072 | 7/1991 | Becuwe | 149/19.4 |

*Primary Examiner*—Charles T. Jordan
*Assistant Examiner*—Theresa M. Wesson
*Attorney, Agent, or Firm*—Paul S. Clohan; William E. Eshelman

[57] ABSTRACT

A method and apparatus for injecting a liquid through a liquid passage connecting a liquid chamber to an outlet in the vicinity of the entrance of a gun bore. The liquid is forced through the passage by a piston movable in the liquid chamber in response to the pressure of a gas generated in a propellant chamber by combustion of a propellant for propelling a projectile down the bore. Two pistons and two liquid chambers may be arranged opposite to each other in a common plane with the propellant chamber and the outlets of the liquid passages may be located substantially opposite to each other in a wall of the bore. Each liquid passage may be arranged to inject the liquid in a tangential direction relative to the longitudinal axis of the bore so that centrifugal forces spread the liquid as a film around the circumference of the bore. Valves may be provided to close the respective liquid passages in the absence of pressure in the liquid chambers.

20 Claims, 4 Drawing Sheets

FIG. 1
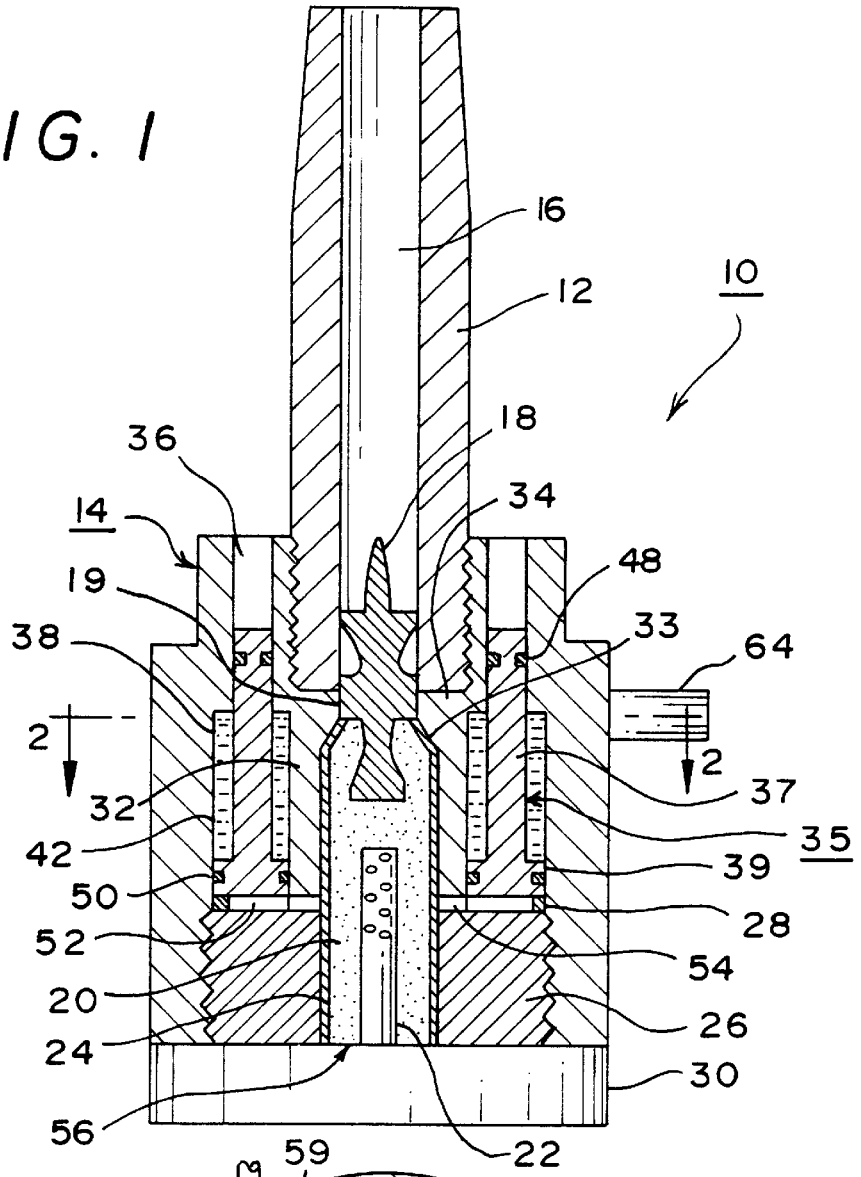
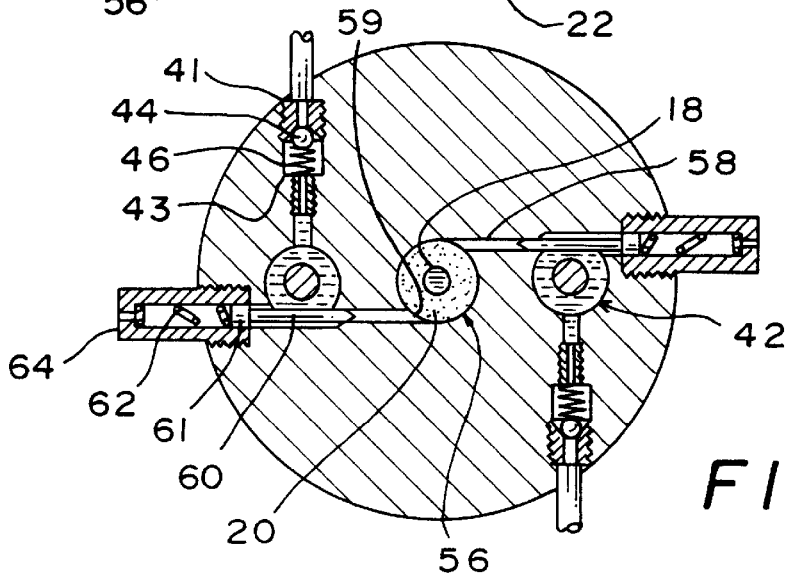
FIG. 2

FIG. 3
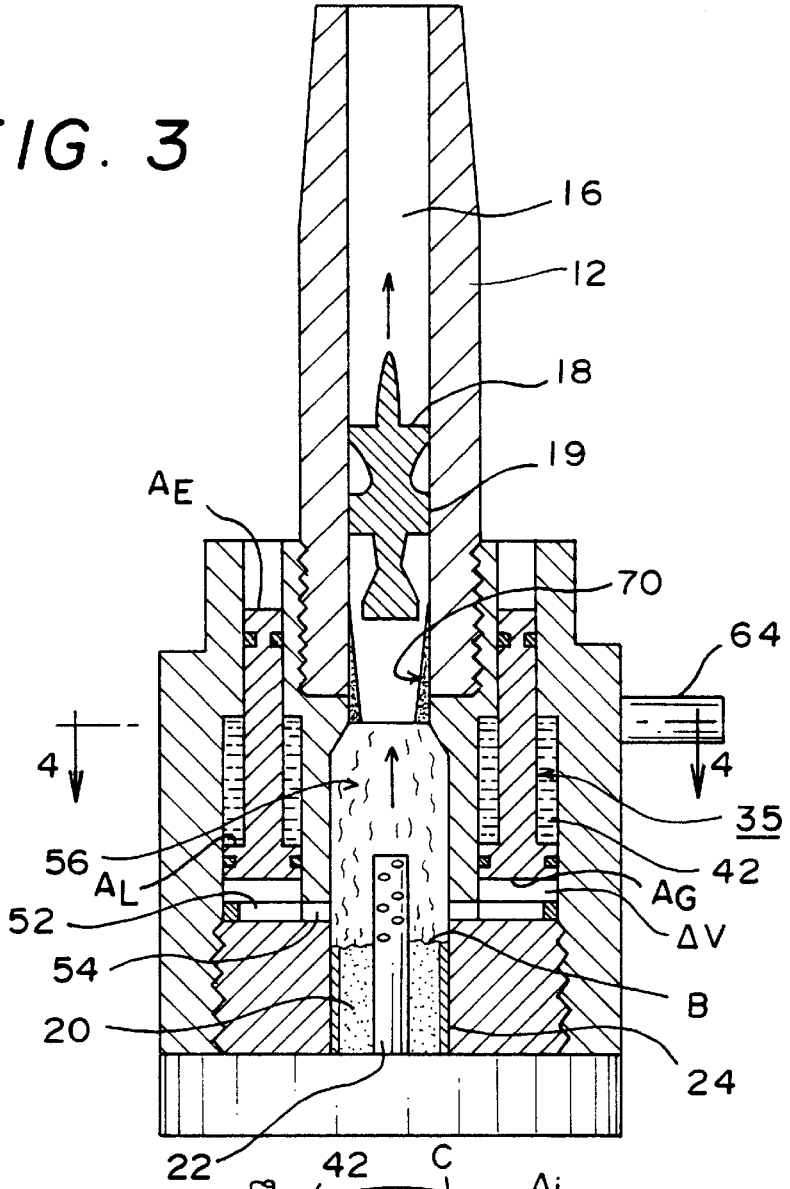
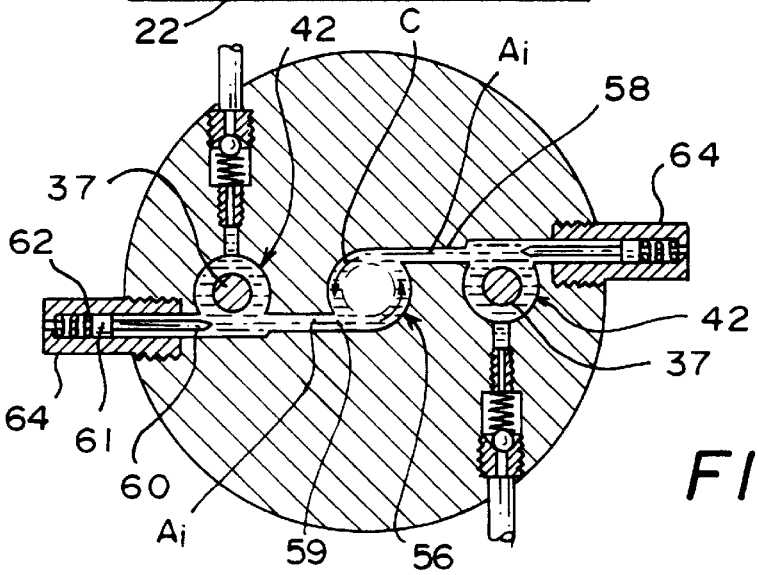
FIG. 4

METHOD AND APPARATUS FOR LIQUID INJECTION TO REDUCE GUN BARREL EROSION

TECHNICAL FIELD

The invention relates to methods and devices for reducing erosion in the bores of gun barrels caused by hot propellent gases generated by the ammunition, and more particularly to a method and apparatus for providing a thin protective film by injecting a liquid into the bore of the gun barrel.

BACKGROUND OF THE INVENTION

While the exact mechanisms for bore erosion may still be debatable, it is well established that the higher the surface temperature of the bore during firing of the ammunition, the more severe is the erosion. Several factors are believed to contribute to bore erosion. These include removal of material from the surface of the bore due to mechanical action, either by the projectile passing through the barrel or by the high velocity of the hot gases driving the projectile. Various thermal and chemical effects aid these processes. Also, the hot propellent gases may overheat the barrel, thereby subjecting it to increased frictional wear. In extreme cases, the barrel material may soften to where there is permanent deformation or warping. Barrel life is greatly reduced under such conditions. It is therefore apparent that significantly reducing barrel heating and bore erosion would significantly improve the service life of guns, particularly those of large caliber and/or high muzzle velocity.

With ever increasing demands for higher muzzle velocities and rates of fire, barrel erosion and barrel overheating have become significant problems in modern guns of various types. Higher muzzle velocities are obtained by increasing the operating pressures of the propellant gases and by the use of propellants with higher flame temperatures. The penalties associated with such improvements are increased barrel wall temperature and the attendant effects of increased erosion and bulk barrel temperature, all of which shorten the barrel service life and limit the rate of fire. Four different approaches have been tried in the past to find a solution that will effectively reduce barrel heating and erosion while maintaining desired muzzle velocities and rates of fire.

In the first approach, the bore of the barrel has been plated with chrome or some other hard refractory metal. However, such plating has a limited lifetime because it develops microcracks that cause peeling of the plated coating. A second approach involves the use of additive wear liners such as dimethylsilicone, talc-wax, or titanium dioxide-wax. These additives coat the surface of the bore and thereby reduce heat transfer and chemical attack on the bore wall.

The third approach for erosion and wear reduction is believed to be the most effective conventional way to decrease heat transfer to the barrel wall. This approach involves the use of additives mixed with the propellent to lower the flame temperature significantly, while imparting only a modest penalty to propellant performance. These additives are mostly binders that are less energetic than the main propellent material and generate low molecular weight combustion products. Examples of such additives are shown in FIG. 5 of the drawings. Another such additive is oxynitrotriazole as described in U.S. Pat. No. 5,034,072.

The fourth approach, the practicality of which may not have been demonstrated, involves providing a liquid cooling medium from the projectile itself. In this approach, a liquid filled capsule at the rear of the projectile ejects liquid onto the surface of the barrel bore as the projectile is propelled down the barrel and as the capsule is squeezed by the pressure of the propellant. An example of this approach is described in U.S. Pat. No. 4,203,364, entitled "Cartridge for Reducing Bore Erosion and Extending Barrel Life".

SUMMARY OF THE INVENTION

The invention provides a method and apparatus for significantly reducing gun barrel erosion and bulk barrel temperature in solid propellant guns by the injection of a liquid coolant onto the entrance surfaces of the barrel bore. Although the coolant may be injected via a plurality of passages extending radially relative to the axis of the bore, it is preferably injected from opposite directions through two passages each extending tangentially relative to the bore axis. Tangential injection is preferred because it utilizes centrifugal force to spread the liquid coolant circumferentially around the curved wall of the bore. The liquid coolant is fed to the injection passages from an annular liquid chamber formed between the rod of an injection piston and a surrounding housing wall provided by the gun block adjacent to its ammunition (breech) chamber.

One side of the piston head contacts the liquid and the opposite side is exposed to a gas chamber that is fed with a portion of the propellant gases so that, upon firing of the ammunition, the piston is driven forward to inject the coolant into the bore at or immediately behind the base of the projectile as it starts down the bore of the gun barrel. The liquid is injected at a pressure higher than the pressure of the propelling gases because the area of the head in contact with the gas is substantially larger than the area of the head in contact with the liquid. Although the preferred embodiment utilizes two coolant chambers and pistons, it is feasible to use one piston or more than two pistons each with its corresponding liquid chamber and injection passage.

Because the injected liquid spreads down the barrel wall as a thin vaporizing film immediately behind the projectile, the injected liquid effectively cools the barrel and shields the barrel wall from the hot propelling gases generated by the burning solid propellant. This shielding effect, which is more pronounced at the entrance to the barrel bore where the film is thickest and where the most erosion would otherwise occur, enables the use of "hot" (highly energetic) propellants for increased muzzle velocity without the need to increase the pressure in the breech chamber. Without the shielding effect, such hot propellants cannot be used effectively without special means for cooling the barrel wall externally. In the absence of external cooling or the shielding effect provided by the present invention, severe erosion would be produced by the very hot combustion gases generated by the burning of these hot propellants. Thus, the invention also enables a gun to have an increased firing rate without the need for externally cooling the barrel. The invention is particularly useful when applied to tank guns and to howitzers.

The present invention therefore teaches a method and apparatus whereby a coolant liquid is injected at or near the entrance to the barrel bore during each firing of the ammunition, which is the location most susceptible to combustion gas erosion. The liquid injection pressure is derived directly from the breech pressure by means of one or more differential area pistons. This arrangement provides for a compact and simple construction of the breech block. Because the liquid is preferably injected rapidly and tangentially relative to the bore axis, it spreads around the curved bore wall as a thin film due to centrifugal forces, and this liquid and its vapor will stay in the boundary layer as they follow the projectile down the barrel. Thus, the liquid and/or the vapor shield the barrel wall from the main hot gas flow, and the barrel temperature is lowered with less reduction of the muzzle energy than if protecting additives were included along with propellant in the propellant charge. Suitable coolant liquids for injection are water, methanol, ethanol, antifreeze solutions, and combinations thereof, and these are readily available. The alcohols and their solutions are preferred because they have low freezing points.

The present invention has numerous advantages over the prior art technology discussed in the Background above. Whereas the invention provides barrel cooling, barrel chrome plating does not reduce heat transfer from the hot gases. Hence, the increase in the bulk barrel temperature of plated barrels limits the sustained firing rates usable with such barrels. Furthermore, it is difficult and expensive to obtain a uniform chrome plating in the bore of a barrel.

Wear reducing additives consume propellant charge space and limit the geometry of the charge. These additives also are less effective when used in high performance guns. Propellant additives that lower flame temperature may appear to be promising, but they impart significant performance penalties and may shorten the shelf life of the main propellant and compromise its mechanical integrity. Liquid capsules at the rear of the projectile would significantly increase the cost of the ammunition and are believed to be impractical for most projectile designs. Even if practical, liquid capsules would be capable of cooling only around the moving projectile and therefore would be primarily effective well down the barrel length, not at the beginning of the barrel where erosion is most prominent.

BRIEF DESCRIPTION OF THE DRAWINGS

The construction, operation and advantages of the present invention may be understood and appreciated more fully from the detailed description below taken in conjunction with the accompanying drawings, in which:

FIG. 1 is a plan view in cross section of the invention before firing of the gun;

FIG. 2 is a transverse cross-sectional view taken along lines 2—2 of FIG. 1;

FIG. 3 is a plan view in cross section illustrating operation of the FIG. 1 embodiment after firing of the gun;

FIG. 4 is a transverse cross-sectional view taken along lines 4—4 of FIG. 3;

DETAILED DESCRIPTION OF PREFERRED EMBODIMENTS

Figure 5:
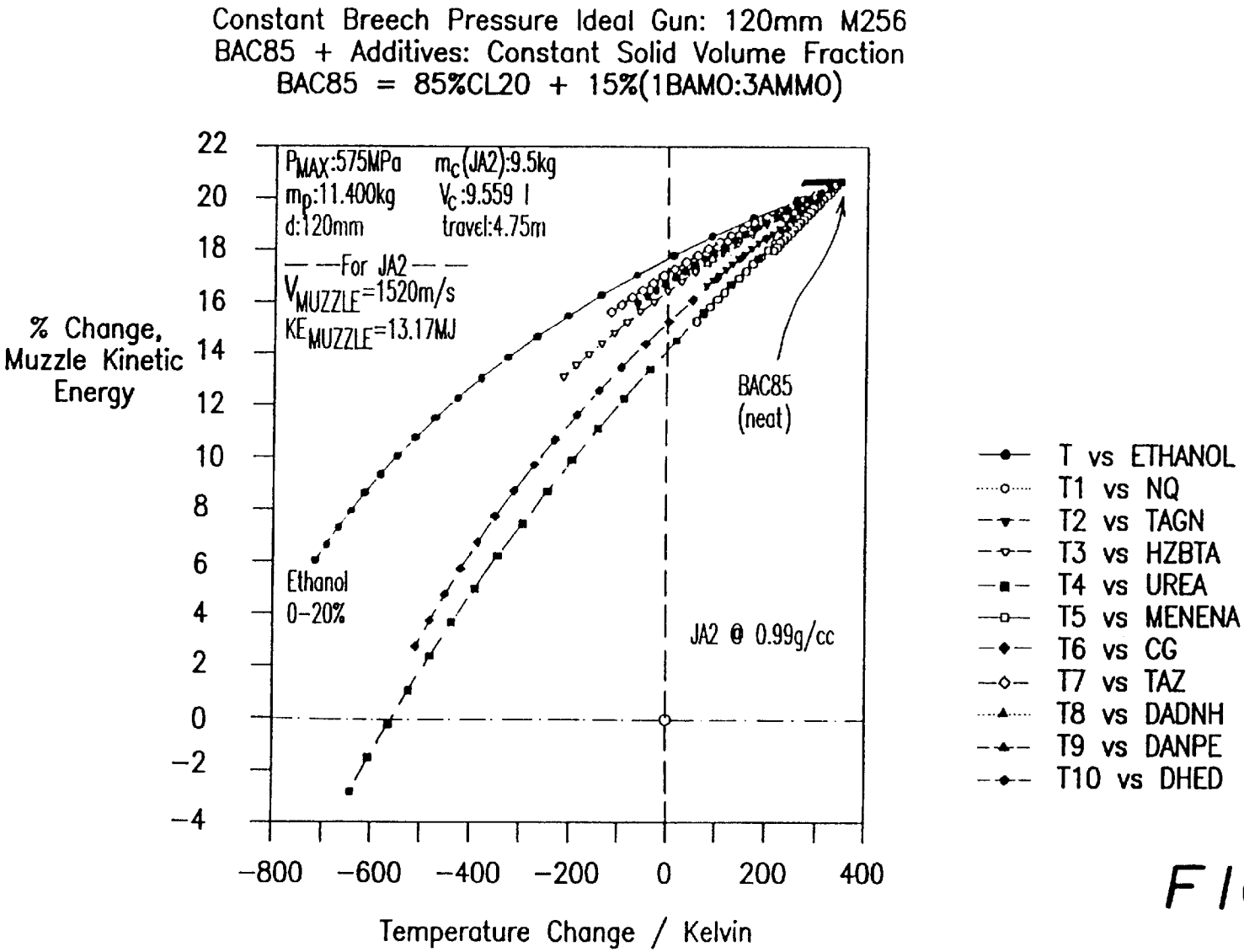
FIG. 5 is a graph illustrating the change in gun muzzle kinetic energy from the base line energy of a base line propellant versus the change in propellant gas temperature from the base line temperature achieved by burning a hot propellant in the presence of ethanol as the liquid coolant used in the invention, and in the presence of various solid additives of the type mixed with a hot propellant; and, FIG. 6 is a diagrammatic illustration of the term "Constant Solid Volume Fraction" as used in the ballistic calculations plotted in FIG. 5.

There is shown in FIG. 1 a preferred embodiment of the invention as employed in a generic tank gun, generally designated 10, having a barrel 12 screwed into a gun block 14. Shown in the bore 16 of the barrel 12 is a projectile 18 backed by a propellent charge 20 and an ignitor 22 contained in a combustible casing 24. The projectile 18 has a base 19, the periphery of which is adapted to slide along the curved wall of the bore 16. If the gun is an artillery piece that does not use a cartridge as represented by the casing 24, the propellant charge 20 may be encased in bags as used for separately loaded ammunition.

The casing 24 is shown inserted into a breech (propellant) chamber 56 of the gun block 14 where it is held in position for firing by a breech plug 26 that screws into the rear of block 14 until it abuts against an annular spacer member 28. A breech plate 30 is then closed to lock and seal the casing 24 within the breech chamber 56. A forward casing seat 33 is defined by a housing wall 32 of the gun block. The housing wall 32 also forms the cylindrical breech chamber for receiving the casing 24. An outer portion 34 of housing wall 32 forms an entrance to the bore 16 and a seat for the inner end of the barrel 12.

The gun block 14 includes two identical stepped bores each having an outer bore portion 36 for guiding a rod 37 of a piston 35, and an inner bore portion 38 that is stepped radially outward from the outer bore 36 for receiving a piston head 39 arranged for sliding movement therein. An annular liquid chamber 42 is thus defined between the piston rod 37 and the surface of the inner bore 38. Liquid leakage around piston rod 37 is prevented by an O-ring seal 48 and liquid leakage around piston head 39 is prevented by an O-ring seal 50. The outer ends of piston rods 37 are exposed to ambient pressure. Referring now to FIG. 2, liquid chamber 42 is filled through an inlet passage 43 containing a fitting 41 providing a one way check valve as illustrated by a ball valve element 44 held against a valve seat by a spring 46.

When each piston head 39 is in its fully retracted position, it is seated against spacer 28 so as to be in spaced relation to the breech plug 26 and to define therebetween a gas chamber 52. Each gas chamber 52 is in fluid communication with the breech chamber 56 via a gas passage 54. As shown in FIG. 2, the axes of the piston rods preferably lie in a common plane with a central axis of the bore 16.

Each liquid chamber 42 is in fluid communication with the breech chamber 56 via a liquid passage 58 containing a stem valve 60 biased to the closed position shown in FIG. 2 by a coil spring 62 held in a valve housing 64 that is mounted by its threaded engagement with the gun block 14. The outlet 59 of the liquid passage 58 is in the vicinity of the bore entrance as formed by housing wall portion 34. In its closed position, the stem valve 60 seals the passage 58 so as to keep liquid from flowing from liquid chamber 42 to breech chamber 56 when chamber 42 is at ambient pressure. During the filling of liquid chamber 42 via valve fitting 41 in inlet passage 43, chamber 42 becomes slightly pressurized. This pressure acts on head 61 of stem valve 60 to cause the valve 60 to retract slightly, thereby momentarily opening the valve to vent air to ambient via liquid passage 58 and gun bore 16. Once the air is vented and the liquid fill pressure is terminated, the pressure in liquid chamber 42 returns to ambient and valve 60 closes fully.

Operation of the invention will now be described with reference to FIGS. 3 and 4. The ignitor 22 is fired in conventional fashion and causes the propellant charge 20 to ignite and burn, which also burns away the combustible casing 24. As the gas pressure rises due to combustion of the propellant charge in the breech chamber 56, the projectile 18 is propelled rapidly forward under the action of the expanding gas. A portion of the gas generated is communicated to the gas chambers 52 where its pressure acts on the area $A_G$ of the piston head 39, thereby causing the pressure of the liquid in chamber 42 to also rise. The liquid pressure then rises above the gas pressure because the cross-sectional area $A_E$ at the end of piston rod 37 is exposed to ambient pressure, and therefore the liquid contact area $A_L$ of piston head 39 is substantially less than the gas contact area $A_G$, i.e., $A_L=A_G-A_E$. As the liquid pressure rises, it causes stem valve 60 to retract against the tension of spring 62, thereby opening the valve and allowing the liquid in chamber 42 to be injected into the bore 16 in the vicinity of its entrance as formed by the housing wall portion 34 adjacent to the outer portion of breech chamber 56. In the "vicinity" of the bore entrance may include an outer part of the breech chamber or an inner part of the barrel 12 so long as the film 70 forms immediately behind the projectile base 19 as it leaves its rest position adjacent to the breech chamber.

Although the liquid passages 58 may enter the bore from a radial direction, it is preferable that the passages 58 enter the bore tangentially as shown in FIG. 4. In addition, the respective areas $A_G$ and $A_L$ and the liquid passages 58 are sized so that the liquid is injected tangentially along the curved bore wall above the casing 24 at a sufficiently high velocity to provide the centrifugal forces needed to spread the liquid as a substantially uniform thin film 70 over the entire circumference of the inner end of the gun bore immediately behind where it is contacted by the perimeter of the projectile base 19. As the projectile 18 leaves its rest position, the liquid also flows into the inner end portion of the gun barrel 16 behind the projectile 18, where it continues to form the thin film 70 of liquid and/or vapor.

Thus, because of the centrifugal force provided by the tangential injection, the injected liquid spreads out as the thin film 70 on the barrel wall. The hot gas flow in the barrel pushing the projectile 18 also pushes the liquid layer 70 down the barrel on its bore wall, while vaporizing at least a portion of the liquid. Because the liquid and its vapor are in the boundary layer in contact with the bore wall, they follow the projectile down the barrel but at a lower speed than that of the projectile. The spreading liquid film 70 and the vapor produced thereby shield the barrel from the main hot gas flow, and also the temperature of the barrel is lowered due to the cooler liquid and the conversion of at least a portion of the liquid, if not all, to vapor. The physics of the liquid injection may be represented by the equations set forth below.

The balance of forces on the piston 35 may be represented as:

$$P_L = P_G \frac{A_G}{A_G - A_E} \tag{1}$$

where $P_G$ and $P_L$ are the gas and liquid pressures, $A_G$ is the area of the piston head contacted by the gas and $A_E$ is the cross-sectional area of the piston rod.

The liquid mass injection rate is:

$$m_L=\rho_L A_{2i} V_L \tag{2}$$

where $\rho_L$ is the liquid density, $V_L$ is the liquid injection velocity, and $A_{2i}$ is the total cross-sectional area of the two liquid injection passages 58, i.e., $A_i+A_i=A_{2i}$.

$V_L$ is found from the Bernoulli equation:

$$V_L = C_D \sqrt{2(P_L - P_G)/\rho_L} \tag{3}$$

where $C_D$ is the discharge coefficient. For a practical design of piston 35, a value of $P_L$=1.33 $P_G$ is reasonable and this will result in injection velocities of 400 to 600 meters per second (m/s).

Suitable liquids for use in liquid chambers 42 include, without limitation, water, methanol, ethanol, and water solutions containing these alcohols or other antifreeze compositions. The alcohols and their solutions are preferred because they are readily available and easily vaporized, and have low freezing points and good cooling and protective characteristics. However, because these liquids do not increase the chemical energy available to the system, there is a penalty associated with the injection of these liquids into the bore of the gun barrel. The liquid is, in effect, a parasitic mass that is accelerated down the barrel by the gas flow, thereby consuming energy that otherwise would be available for transfer to the projectile 18 as kinetic energy.

On the other hand, because the hot combustion gas is cooled by the liquid, a hot burning propellant may be used that is more energetic than a base line (standard) propellant so that the projectile actually may gain considerably more muzzle kinetic energy without exceeding the desirable base line gas temperature at the wall of the bore. As a conservative example in support of this advantage, it may be assumed that the injected liquid instantly mixes with the propellant gas and immediately vaporizes, and that this vapor reaches physical, chemical and thermal equilibrium with the propellant gas. In other words, it is assumed that a portion of the system energy is used for completely vaporizing the liquid and for accelerating this vapor to the full velocity of the combustion gas. This is a conservative case because in reality the liquid and its vapor will reside in the boundary wall layer, lag the projectile motion, and leave unaffected the core of the gas in the bore of the barrel.

Shown in FIG. 5 by way of example are the results of ballistic calculations done with the Chem P method for injected ethanol and various solid additives. The Chem P method is presented in a paper by A. J. Kotlar entitled "The Effect of Variable Composition Equilibrium Thermochemistry In Constant Breech Pressure (CBP) Gun Simulations," Proceedings of the 15th International Symposium on Ballistics (1995), Vol. 3, p. 119–126. This method models an idealized gun system and adequately simulates optimized guns by imposing constant breech pressure, a Lagrange pressure gradient, perfect mixing, and chemical equilibrium. The gun in the FIG. 5 example is a standard 120 millimeter M256 tank gun. The base line propellent is known as JA2, the hot burning propellant is known as BAC85, and the cooling liquid is ethanol.

Because the premixing of various additives with the hot propellant BAC85 is an alternative to injecting ethanol or other liquids in accordance with the invention, the effects of mixing various solid additives with BAC85 are also shown in FIG. 5. The acronyms shown in FIG. 5 for the hot propellant and its solid additives have the following meanings: NQ is nitroguanidine, TAGN is triaminoguanidinium nitrate, HZBTA is hydrazinium bitetrazolamine, UREA is the generic name for carbamide, MENENA is N-methylbetanitroxyethynitramine, CG is cyanoguanidine, TAZ is triaminoguanidinium azide, DADNH is 1,6-diazido-2,5-dinitrazahexane, DANPE is 1,5-diazido-2-nitrazapentane, DHED is dihydrazine ethylenedinitramine, CL20 is hexanitrohexaazaisowurtzitane, BAMO is 3,3-bis(azidomethyl)oxetane, and AMMO is 3-azidomethyl-3-methyl oxetane.

The results of the ballistic calculations are plotted in FIG. 5 as the percent change in muzzle kinetic energy from the base line energy versus the change in gas temperature from the base line temperature. These results show that it takes only 4 percent (4%) by weight of added liquid mass (ethanol) to cool the hotter combustion gas from burning BAC85 to the base line JA2 gas temperature, while still retaining over 80 percent (80%) of the muzzle kinetic energy gain for transfer to the projectile. Furthermore, the injected liquid performance is substantially better than that of any of the premixed additives.

Figure 6:
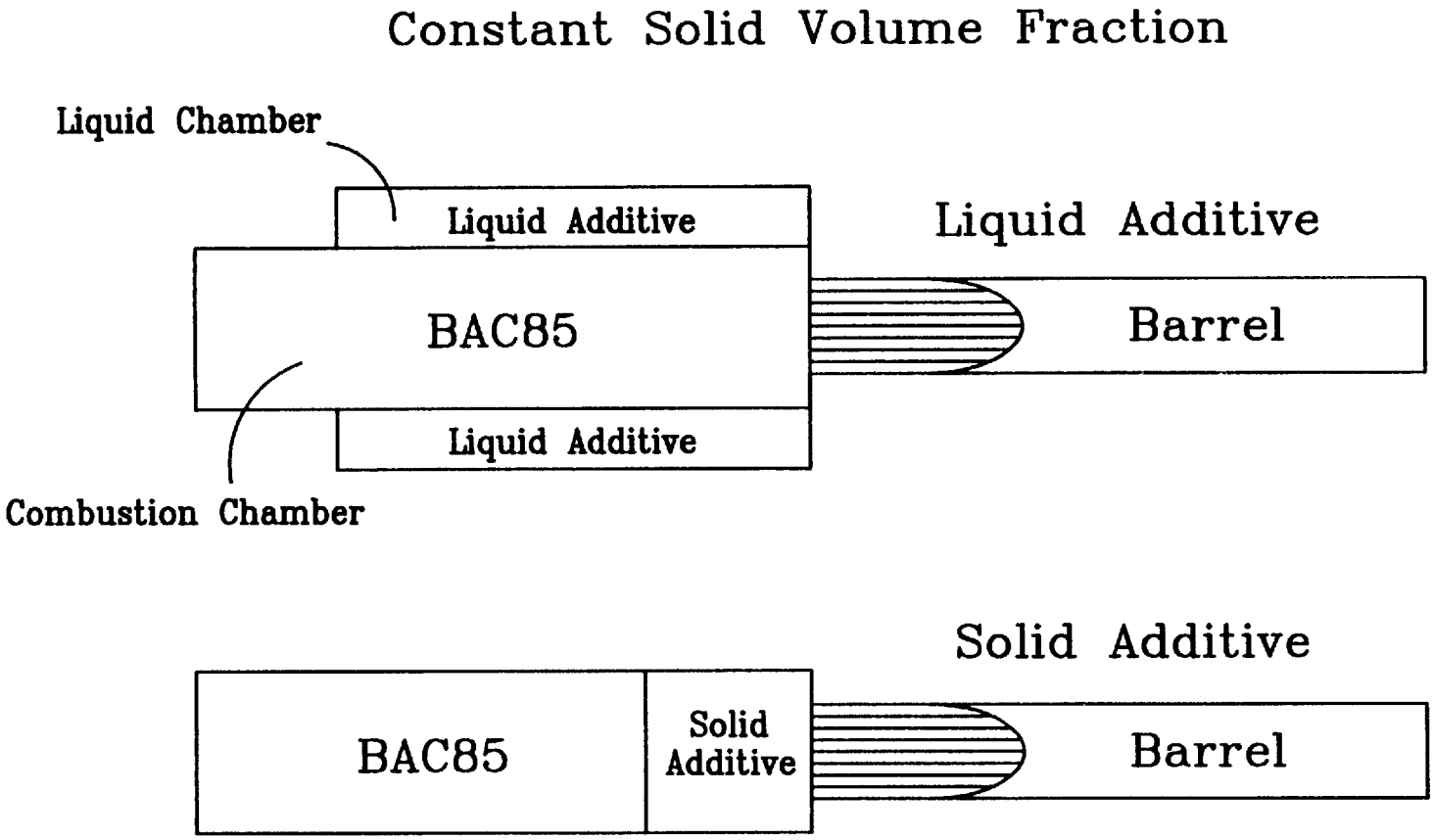

Because the solids of the propellant and its additives are in granular form, the charge is porous and the actual loading density of the solids in the combustion (breech) chamber is less than their intrinsic density. The volume fraction is the ratio between the loading density of the baseline propellant JA2 (0.99 g/cc) and its intrinsic density (1.573 g/cc), i.e., 0.629. In the ballistic calculations, the mass of the solids is calculated such that the volume of the solids is a constant 0.629 of the combustion chamber volume. Because different solid additives have different densities, the actual charge mass will vary according to the additive used. In the case of a liquid additive in accordance with the invention, the charge mass is that of the BAC85 plus the liquid mass. In the corresponding ballistic calculations, the combustion chamber volume is increased by the volume of the liquid. Therefore, the calculations for both solid and liquid additives, as plotted in FIG. 5, were based on a "Constant Solid Volume Fraction" as illustrated diagrammatically in FIG. 6.

Bearing in mind that the calculations are overly conservative with respect to the liquid injection case but not the additive cases, the superiority of liquid injection according to the invention is even more striking. In reality, with liquid injection, the boundary layer on the inner surface of the barrel will be far cooler than with any of the additives because additive cooling is a bulk process throughout the breech chamber 56, while the liquid cooling is a boundary layer process as represented by the thin film 70. Similar ballistic calculations with water as the injected liquid indicate that for the same liquid percentage, there is a greater performance penalty with water than with ethanol. The reason for this is believed to be that ethanol generates hydrogen that lowers the average molecular weight of the propelling gases, whereas water generates water vapor that is heavier than hydrogen. In other words, the lower the average molecular weight of the propelling gas and vapor mixture, the better the performance achieved by liquid injection.

While the invention has been described above in conjunction with the preferred embodiments thereof, many changes, modifications, alterations and variations will be apparent to those skilled in the art when they learn of the invention. Thus, although the invention is described in conjunction with a particular projectile cartridge, it is also applicable to other types of cartridges and to ammunition of the non-fixed type where the propellant is loaded separately from the projectile. It is also feasible to use only one injection piston of the type shown, or to use more than two such pistons. It is also feasible to use an annular piston movable in an annular liquid chamber concentric to the breech chamber 56, such a piston and chamber arrangement being shown and described in my copending application, Ser. No. 08/946,863, which is pending and is entitled "Method and Apparatus for Dispensing Liquid with Gas", the entire contents of this copending application being incorporated herein by reference. Accordingly, the preferred embodiments of the invention set forth above are intended to be illustrative, not limiting, and various changes may be made without departing from the spirit and scope of the invention as defined by the claims set forth below.

What is claimed is:

1. A gun having a bore for discharging a projectile with a gas, said gun comprising:

a housing defining a propellant chamber adapted to contain a propellant to be burned for generating the gas, said propellant chamber being connected to an entrance into the bore to provide a portion of the gas for propelling the projectile down said bore away from said entrance;

a piston arranged for movement in a piston chamber defined by said housing and cooperating with a wall of said piston chamber to provide a liquid chamber for holding a liquid when said piston is in a retracted position;

at least one liquid passage connecting said liquid chamber and said bore, and having an outlet in the vicinity of said bore entrance;

a gas chamber arranged in said housing to exert a pressure of the gas against a first face of said piston opposite to a second face of said piston for contacting the liquid in said liquid chamber; and at least one gas passage connecting said gas chamber and said propellant chamber to provide said gas pressure in said gas chamber, the area of said first piston face being larger than the area of said second piston face so that said gas pressure causes said piston to force the liquid out of said liquid chamber and into said gun bore through said liquid passage when the gas is generated by burning the propellant in said propellant chamber.

2. An apparatus according to claim 1, wherein said at least one liquid passage is arranged to inject the liquid into said bore in a tangential direction relative to the longitudinal axis of said bore, and wherein the faces of said piston and said liquid passage are sized such that a centrifugal force acts on said injected liquid to cause it to spread as a film around the circumference of said bore.

3. An apparatus according to claim 1, wherein said piston comprises a head for engaging said piston chamber wall and a rod for engaging a rod bore within said housing, such that said liquid chamber comprises an annular volume around a portion of said piston rod, and movement of said piston in said liquid chamber is guided by the engagement between said piston rod and said rod bore.

4. An apparatus according to claim 3, wherein an end of said rod bore opposite to said liquid chamber is open to ambient pressure.

5. An apparatus according to claim 1 further comprising valve means for sealing said liquid passage in the absence of said gas pressure, and wherein said valve means is responsive to said gas pressure to open said liquid passage when gas is generated by burning the propellant in said propellant chamber.

6. An apparatus according to claim 5 further comprising fill means for introducing said liquid into said liquid chamber when said gas is not being generated, and wherein said valve means is responsive to a pressure created by said fill means so as to open said liquid passage sufficiently to vent air therethrough during the filling of said liquid chamber by said fill means.

7. An apparatus according to claim 1 further comprising means for filling said liquid chamber with the liquid when said gas is not being generated, said fill means including valve means for providing liquid flow into said liquid chamber through an inlet passage in said housing while preventing reverse flow through said inlet passage.

8. An apparatus according to claim 1 further comprising a cartridge adapted to be received in said propellant chamber and having a wall defining a chamber for storing said propellant, and wherein said cartridge wall is made of a combustible material that is adapted to be ignited and converted to combustion gases by the burning of said propellant.

9. An apparatus according to claim 1 further comprising a second piston arranged in a second liquid chamber for movement in response to said gas pressure, and a second liquid passage connecting said second liquid chamber to said gun bore in the vicinity of said bore entrance, and wherein each of said liquid passages has an outlet arranged to eject the liquid into said bore in a tangential direction relative to a longitudinal axis of said bore such that centrifugal forces cause said injected liquid to spread as a film around the circumference of said bore.

10. An apparatus according to claim 9 further comprising corresponding valve means for controlling liquid flow through each of said liquid passages, and wherein each of said valve means contains a valve element responsive to fluid pressure in its corresponding liquid chamber such that each valve element closes its corresponding liquid passage in the absence of substantial fluid pressure in its corresponding liquid chamber and opens its corresponding liquid passage when substantial pressure is present in its corresponding liquid chamber.

11. An apparatus according to claim 10, wherein each of said valve elements is biased by spring means to a position for closing its corresponding passage in the absence of substantial pressure in its corresponding liquid chamber.

12. An apparatus according to claim 9, wherein a longitudinal axis of each of said liquid chambers lies in a common plane with a longitudinal axis of said gun bore, and wherein the outlets of said liquid passages are arranged substantially opposite to each other in a wall of said bore.

13. An apparatus according to claim 12 wherein said liquid chamber axes and said bore axis are substantially parallel.

14. An apparatus according to claim 1, wherein said liquid is water, methanol, ethanol or an antifreeze composition, or a mixture of water and methanol or water and ethanol or water and an antifreeze composition.

15. A method for injecting a liquid into a bore of a gun, said method comprising:

filling a liquid chamber with a liquid, said chamber containing a piston arranged for movement therein and having a first face opposite to a second face for engaging said liquid;

generating a gas by burning a propellant in a propellant chamber connected to an entrance into the bore and defined by a gun housing;

applying a portion of said gas to propel a projectile down said bore away from the entrance thereof; and, applying a pressure of said gas to the first face of said piston to pressurize said liquid, the area of said first piston face being larger than the area of said second piston face so that said gas pressure causes said piston to force the liquid out of said liquid chamber and into said gun bore through a liquid passage connecting said liquid chamber to said bore in the vicinity of said bore entrance.

16. A method according to claim 15 further comprising applying said gas pressure to a second piston responsive to said pressure to inject liquid into said bore in the vicinity of said bore entrance from a second chamber through a second liquid passage connecting said second liquid chamber to said bore, and wherein said liquid passages are each arranged to inject liquid into said bore in a tangential direction relative to a longitudinal axis of said bore such that centrifugal forces cause said injected liquid to spread as a film around the circumference of said bore.

17. A method according to claim 16, wherein the liquid from each of said liquid passages is injected into said bore through a corresponding outlet, and wherein said outlets are located substantially opposite to each other in a wall of said bore.

18. A method according to claim 15 further comprising operating a valve means in response to a pressure of the liquid in said liquid chamber, said valve means comprising a valve member for closing said liquid passage in the absence of said pressure and for opening said liquid passage in response to said pressure.

19. A method according to claim 15, wherein said liquid is water, methanol, ethanol or an antifreeze composition, or a mixture of water and methanol or water and ethanol or water and an antifreeze composition.

20. A method according to claim 15, wherein said liquid passage is arranged to inject the liquid into said bore in a tangential direction relative to a longitudinal axis of said bore such that centrifugal forces cause said injected liquid to spread as a film around the circumference of said bore.

* * * * *